US005475463A

United States Patent [19]

Yamaguchi et al.

[11] Patent Number: 5,475,463

[45] Date of Patent: Dec. 12, 1995

[54] ARRANGEMENT FOR COUPLING FILMS TO LEADER

[75] Inventors: Takuji Yamaguchi; Tohgo Kinoshita; Yasunobu Shimamura; Yuji Yamazoe; Shinji Fukushima; Masayuki Kojima, all of Wakayama, Japan

[73] Assignee: Noritsu Koki Co., Ltd., Wakayama, Japan

[21] Appl. No.: 219,935

[22] Filed: Mar. 30, 1994

[30] Foreign Application Priority Data

| | | | |
|---|---|---|---|
| Mar. 31, 1993 | [JP] | Japan | 5-073159 |
| Apr. 13, 1993 | [JP] | Japan | 5-085039 |
| May 21, 1993 | [JP] | Japan | 5-120110 |
| Jun. 3, 1993 | [JP] | Japan | 5-133193 |
| Jun. 4, 1993 | [JP] | Japan | 5-134593 |

[51] Int. Cl.[6] ..... G03D 3/08

[52] U.S. Cl. ..... 354/321; 354/345

[58] Field of Search ..... 354/319–323, 354/313, 340, 345; 226/91, 92, 170–172; 352/235; 242/74.1, 76, 180, 186; 156/502, 505, 344, 545

[56] References Cited

U.S. PATENT DOCUMENTS

| | | | |
|---|---|---|---|
| 1,389,523 | 8/1921 | Mercer | 156/502 X |
| 1,655,297 | 1/1928 | Thornton | 352/235 |
| 2,433,446 | 12/1947 | Foster | 156/502 |
| 2,590,678 | 3/1952 | Caim | 430/501 |
| 3,462,054 | 8/1969 | Foor | 226/91 |
| 3,646,872 | 3/1972 | Bowlby | 354/312 |
| 4,110,774 | 8/1978 | Krehbiel et al. | 354/345 |
| 5,381,204 | 1/1995 | Grusetski et al. | 345/345 |

FOREIGN PATENT DOCUMENTS

| | | | |
|---|---|---|---|
| 725191 | 9/1942 | Germany | 354/313 |

*Primary Examiner*—D. Rutledge
*Attorney, Agent, or Firm*—Wenderoth, Lind & Ponack

[57] ABSTRACT

Various arrangements are proposed for coupling films to a leader. A hole is formed in one of the films and the leader to receive a tab which is formed on the other. These arrangements allow stable coupling of the films to the leader and easy uncoupling. They eliminate the use of splice tape.

10 Claims, 16 Drawing Sheets

ARRANGEMENT FOR COUPLING FILMS TO LEADER

BACKGROUND OF THE INVENTION

This invention relates to an arrangement for coupling undeveloped films to a leader.

When developing undeveloped films (hereinafter simply referred to as "films") in an automatic film developing machine of a type that utilizes leaders to guide films, the front ends of films F are connected to a leader L after pulling them out of patrones P as shown in FIG. 27. The films F are sent to the film developing unit, led by the leader.

The leader L is formed of a flexible synthetic resin sheet. Along its longitudinal center are formed a plurality of holes a arranged at equal intervals and adapted to engage a feed sprocket provided in the film developing unit.

Such an automatic film developing machine is ordinarily provided with a film guide. If films are detached from the film guide while being fed, their surfaces may be damaged due to contact with the film guide. Thus, it is necessary to couple films reliably to the leader with high positional accuracy.

If a film F should come off the leader L while developing, it will be stuck in the treating solution. It is extremely troublesome to take out such a stuck film. If taken out carelessly, the film F may be exposed to light. Thus, films F have to be rigidly coupled to leaders L.

For this purpose, films F were heretofore connected to a leader F by means of splicing tapes T as shown in FIG. 27.

In order to connect films to a leader using splicing tapes T with high positional accuracy, the leader has to be placed on a special-purpose workbench. It is necessary to keep oil and dust from the adhesive surface of the splicing tapes T. Thus, a taping job tends to be very troublesome. In order to prevent films F from coming off the leader while being fed, it is necessary to use splicing tapes with high bond strength. It is difficult to peel off such tapes after developing films F. Such tapes are not recyclable and thus are uneconomical.

SUMMARY OF THE INVENTION

It is an object of this invention to provide an arrangement for coupling film to a leader which is free of these problems, which makes it possible to couple film to a leader without using a special-purpose workbench and with high positional accuracy and with which films can be easily coupled to and detached from the leader.

In order to attain this object, according to this invention, there is provided an arrangement for coupling a film to a leader, the arrangement comprising an engaging hole means formed in one of the rear end of the leader with respect to the feed direction of the leader and the front end of the film, and an engaging tab means provided on the other of the rear end of the leader and the front end of the film.

By providing an engaging hole in one of the leader and the film and an engaging tab on the other, the film can be coupled to the leader with high positional accuracy by inserting the engaging tab into the engaging hole.

No special workbench is needed to couple the film to the leader. The film can be easily coupled to and detached from the leader simply by inserting and withdrawing the engaging tab into and from the engaging hole.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

The embodiments of this invention will now described with reference to FIGS. 1–26.

Figure 1:
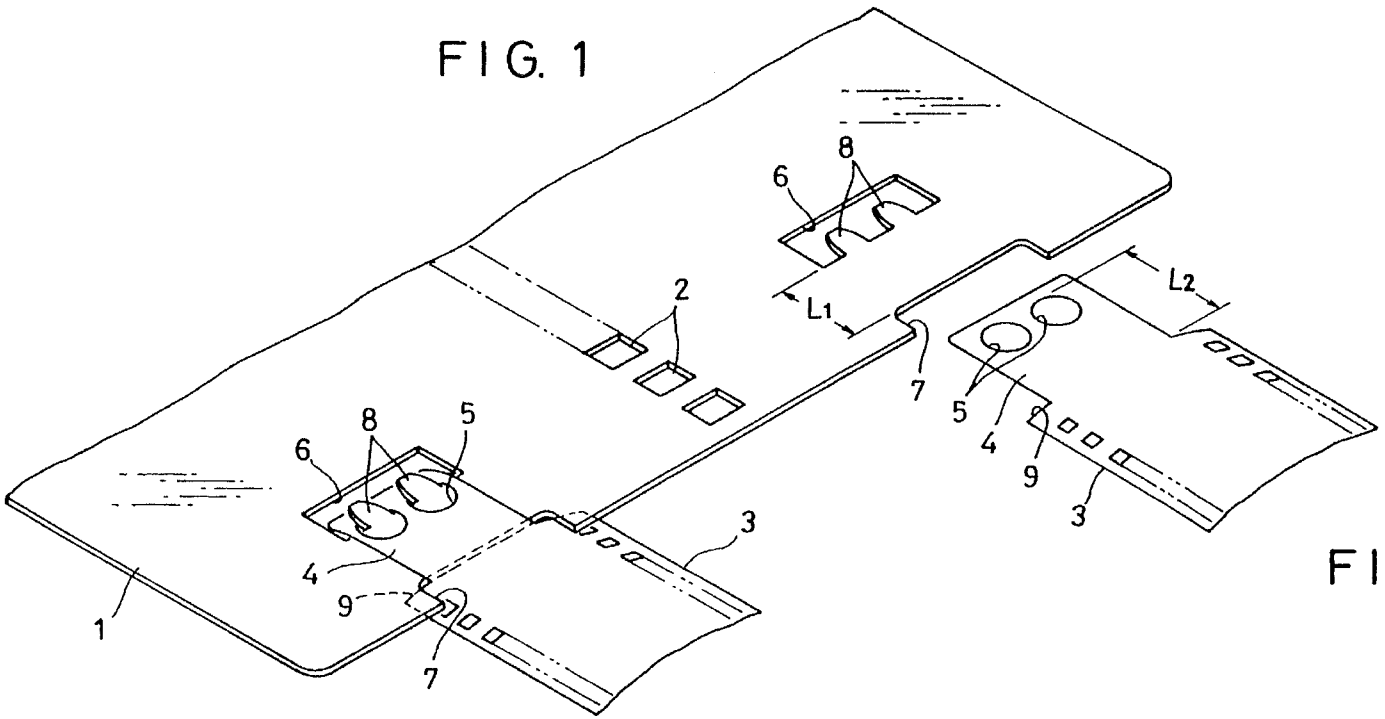
FIG. 1 is a perspective view of a first embodiment of the coupling structure according to this invention.
Figure 2:
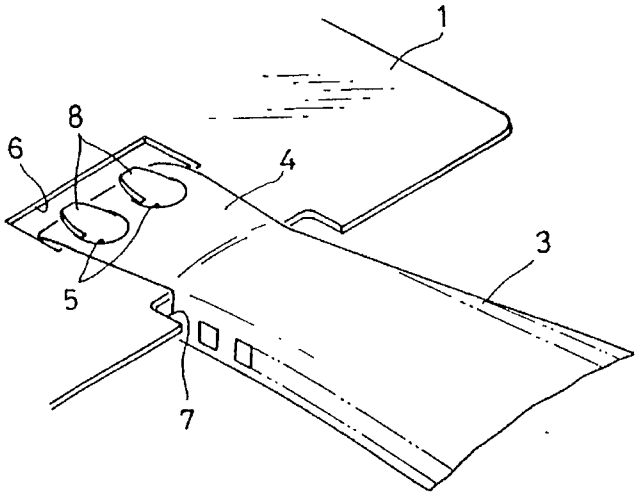
FIG. 2 is a perspective view of the same showing how the film is coupled to the leader.

FIGS. 1 and 2 shows the first embodiment of the coupling structure for coupling a film to a leader 1 according to this invention. The leader 1 is made of a flexible synthetic resin sheet. It has feed holes 2 provided in the transverse center thereof and arranged at equal intervals.

A film 3 adapted to be fed by the leader 1 is provided at its front end with a narrow tab 4 having two engaging holes 5 arranged side by side.

The leader 1 is provided in the rear end thereof (with respect to its feed direction) with a pair of holes 6 arranged symmetrically with respect to the transverse center line of the leader. The leader 1 is also formed with cutouts 7 behind the holes 6.

The holes 6 and the cutouts 7 have to be sufficiently large so that the narrow tab 4 of the film 3 can be inserted therein. A pair of engaging tabs 8 protrude forwardly from the rear edge of each hole 6. They are sized so as to be insertable into the engaging holes 5 of the film 3.

The distance L1 between each hole 6 and cutout 7 is substantially equal to the distance L2 between the shoulders of the film 3 on both sides and the fronts of the engaging holes 5.

In order to couple each film 3 to the leader 1 as shown in FIG. 1, the engaging tab 4 is inserted in the hole 6 and, with the engaging tabs 8 received in the engaging holes 5, the film 3 is pinched to deform it arcuately until its shoulder portions 9 pass through the cutout 7 to the underside of the leader as shown in FIG. 2. The pressure on the film 3 is released in this state. Now, the film is coupled as shown in FIG. 1.

In this coupled state, the tabs 8 are received in the holes 5 and the shoulders 9 on both sides of the film 3 engage the backside of the leader 1 on both sides of the cutout 7. The leader 1 and the film 3 are thus prevented from moving longitudinally and transversely with respect to each other. Also, the engaging tabs 8 are prevented from separating from the surface of the leader 1, so that the engaging tabs 8 will not come out of the holes 5.

The films 3 are thus kept in such a position that they are longitudinally aligned with the leader 1, so that they can precisely follow the leader 1 while they are moving along the developing path in the automatic film developing machine.

In order to detach the films 3 from the leader 1 after developing them, they are deformed arcuately in a transverse direction until the shoulder portions 9 of the films 3 disengage from the backside of the leader on both sides of the cutout 7. Then, the films are moved until the engaging tabs 8 come out of the holes 5.

Figure 3:
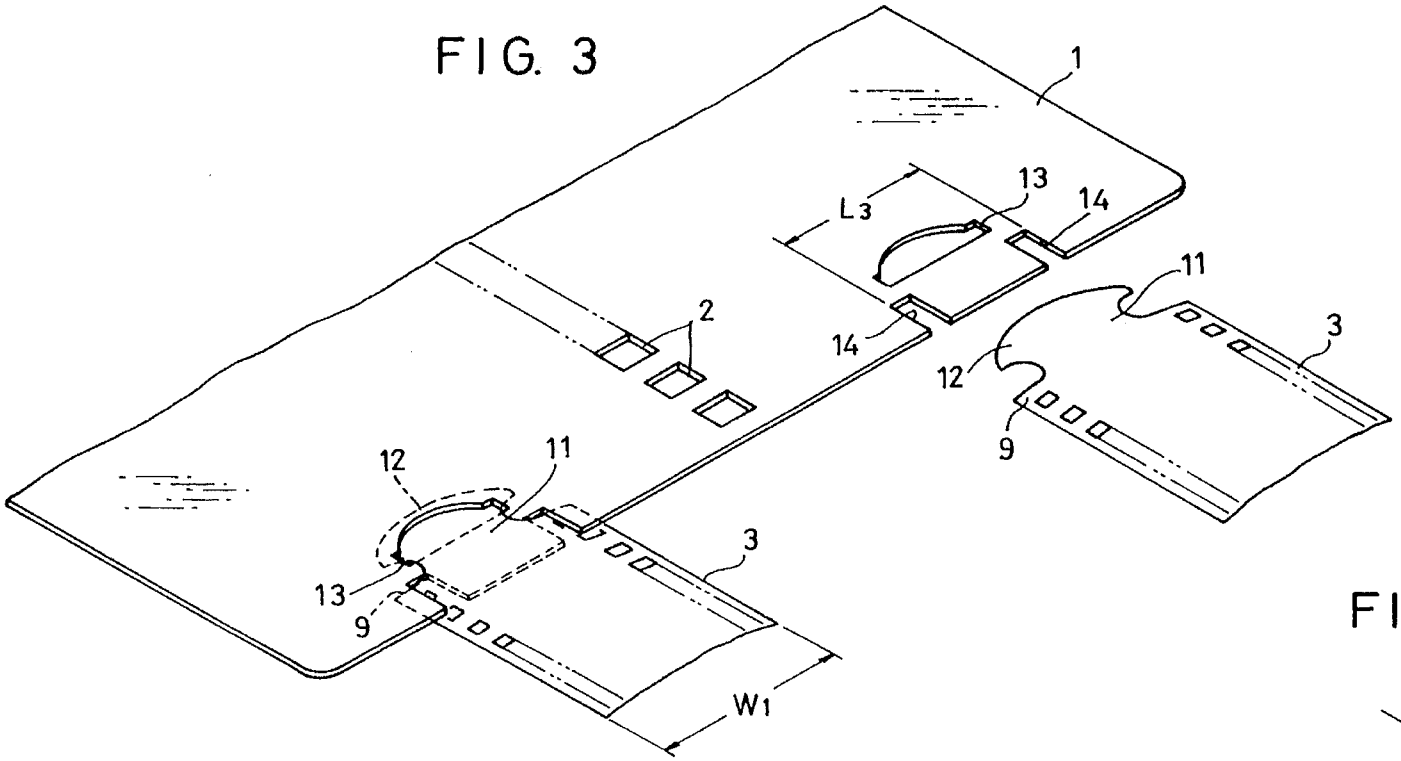
FIG. 3 is a perspective view of a second embodiment.
Figure 4:
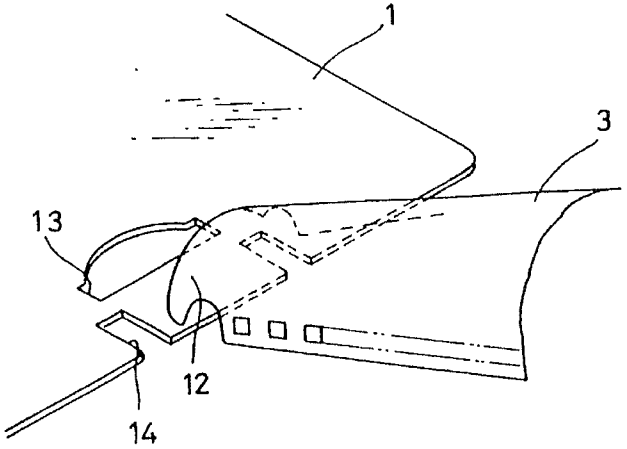
FIG. 4 is a perspective view of the same showing how the film is coupled to the leader.

FIGS. 3 and 4 show the second embodiment of the coupling structure according to this invention. In this embodiment, each film 3 is provided at its front end with an engaging tab 12 having an arcuate front edge and connecting with the film through a neck portion 11.

The leader 1 is provided in the rear end thereof (with respect to the feed direction) with engaging holes 13 for receiving the engaging tabs 12 of the respective films 3. A pair of narrow cutouts 14 are formed in the leader 1 behind each engaging hole 13 and along the rear edge of the leader.

The engaging holes 13 have shapes similar to those of the engaging tabs 12 but slightly larger.

The distance L3 between the outer sides of each pair of narrow cutouts 14 is slightly smaller than the width W1 of the film 3.

In order to couple each film 3 to the leader 1, the films is pinched in a transverse direction to deform it arcuately as shown in FIG. 4. In this state, the engaging tab 12 is pushed into the engaging hole 13 until shoulders 9 of the front edge of the film pass to the backside of the leader. Pressure on the film 3 is removed in this state.

In this coupled state, the engaging tab 12 engages along its edge with the edge of the leader defining the engaging hole 13 and the shoulders 9 engage the backside of the leader 1, so that the leader 1 and each film 3 are prevented from moving relative to each other both longitudinally and transversely.

Figure 5:
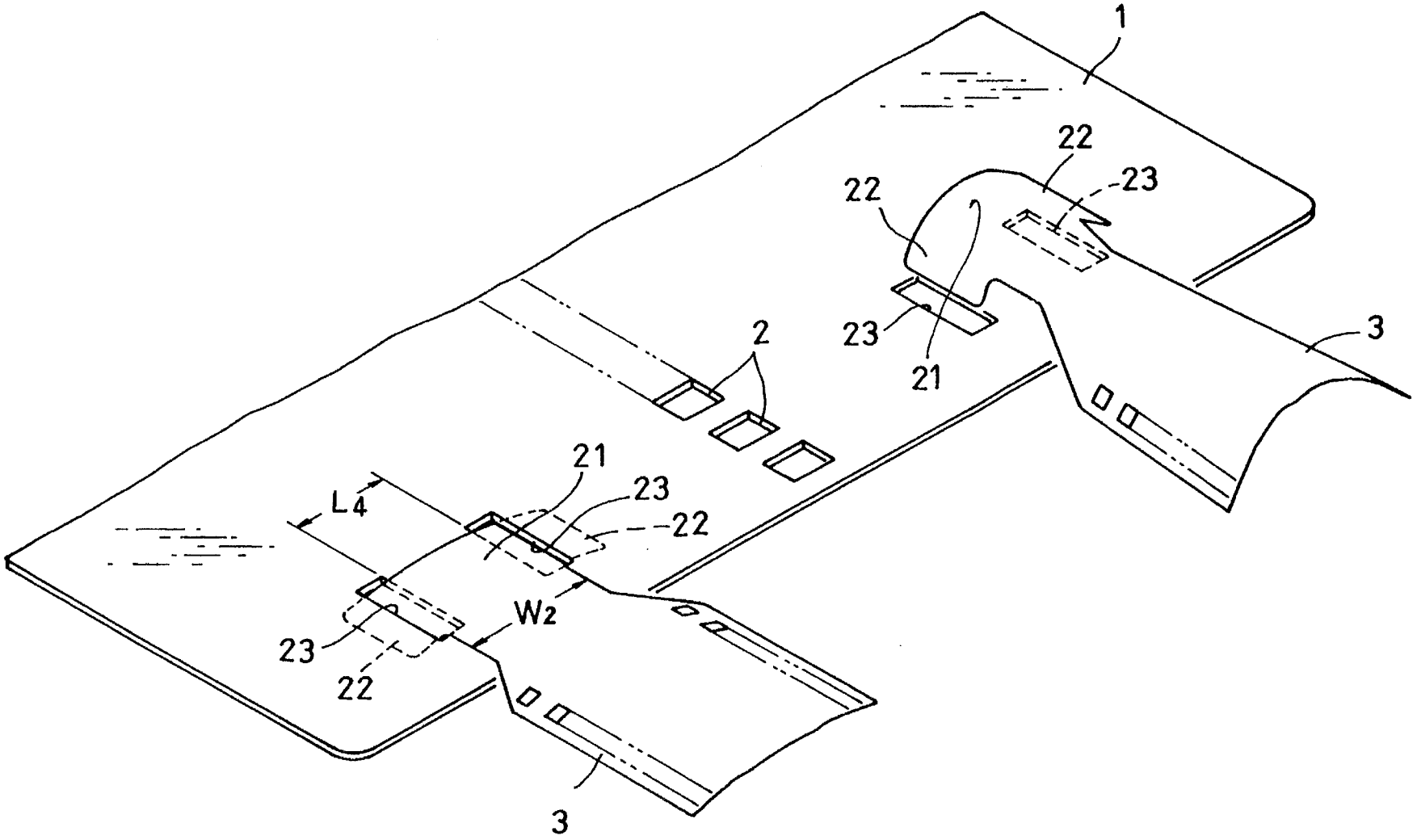
FIG. 5 is a perspective view of a third embodiment.

FIG. 5 shows the third embodiment of the coupling structure according to this invention. In this embodiment, an engaging portion 21 which is narrower than the film 3 is coupled to the front end of the film 3. On both sides of the engaging portion 21 are provided a pair of engaging pieces 22. On each side of the leader 1 is formed a pair of engaging holes 23. The distance L4 between the inner sides of a pair of engaging holes 23 is substantially equal to the width W2 of the engaging portion 21.

In order to couple each film 3 to the leader 1, the film 3 is pinched in a transverse direction to deform it arcuately. In this state, the engaging pieces 22 on both sides of the engaging portion 21 are pushed into the engaging holes 23 until they protrude from the backside of the leader. When the film is released in this state, the engaging pieces 22 engage the backside of the leader 1. Thus, the leader 1 and each film 3 are prevented from moving relative to each other both longitudinally and transversely. Also, they will never be bent.

Figure 6:
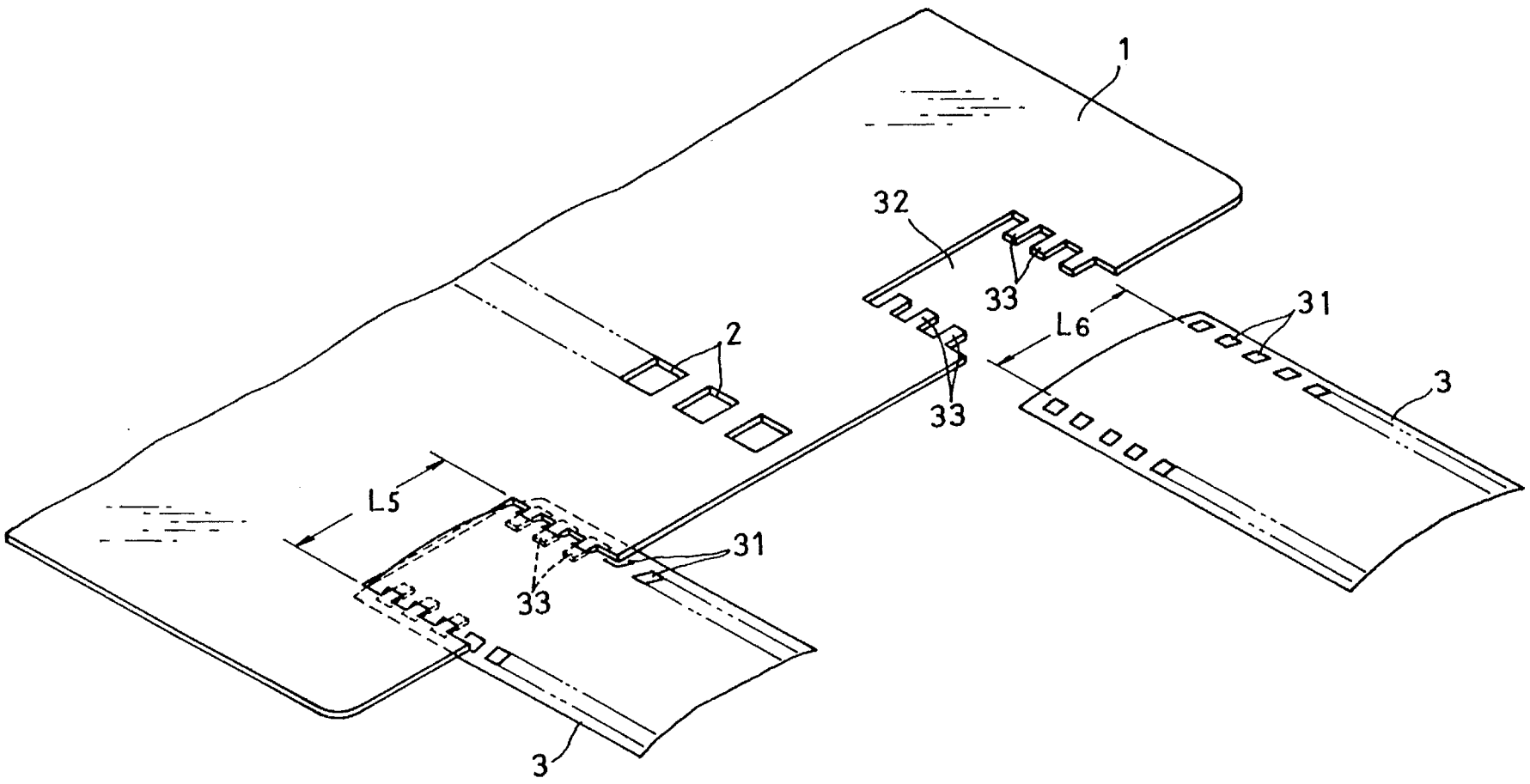
FIG. 6 is a perspective view of a fourth embodiment.

FIG. 6 shows the fourth embodiment of the film coupling structure according to this invention, in which each film 3 has perforations 31 on both sides which serve as engaging holes.

The leader 1 is formed with cutouts 32 at its rear edge. A plurality of engaging tabs 33 are integrally provided along both sides of the cutouts 32 so as to be insertable into the perforations 31.

The distance L5 between the sides of each cutout 32 is substantially equal to the distance L6 between the inner sides of the perforations 31 on both sides of the film 3.

In order to couple each film 3 to the leader 1, the film 3 is pinched in a transverse direction to deform it arcuately until the engaging tabs 33 on both sides of each cutout 32 are inserted into the perforations 31 on both sides of the film 3. pressure on the film 3 is then released.

In this coupled state, the plurality of engaging tabs 33 extend into the perforations 31 formed on both sides of the film 3, while both sides of the front of the film come into engagement with the backside of the leader 1. Thus, the leader 1 and the film 3 are prevented from moving relative to each other both longitudinally and transversely.

Figure 7:
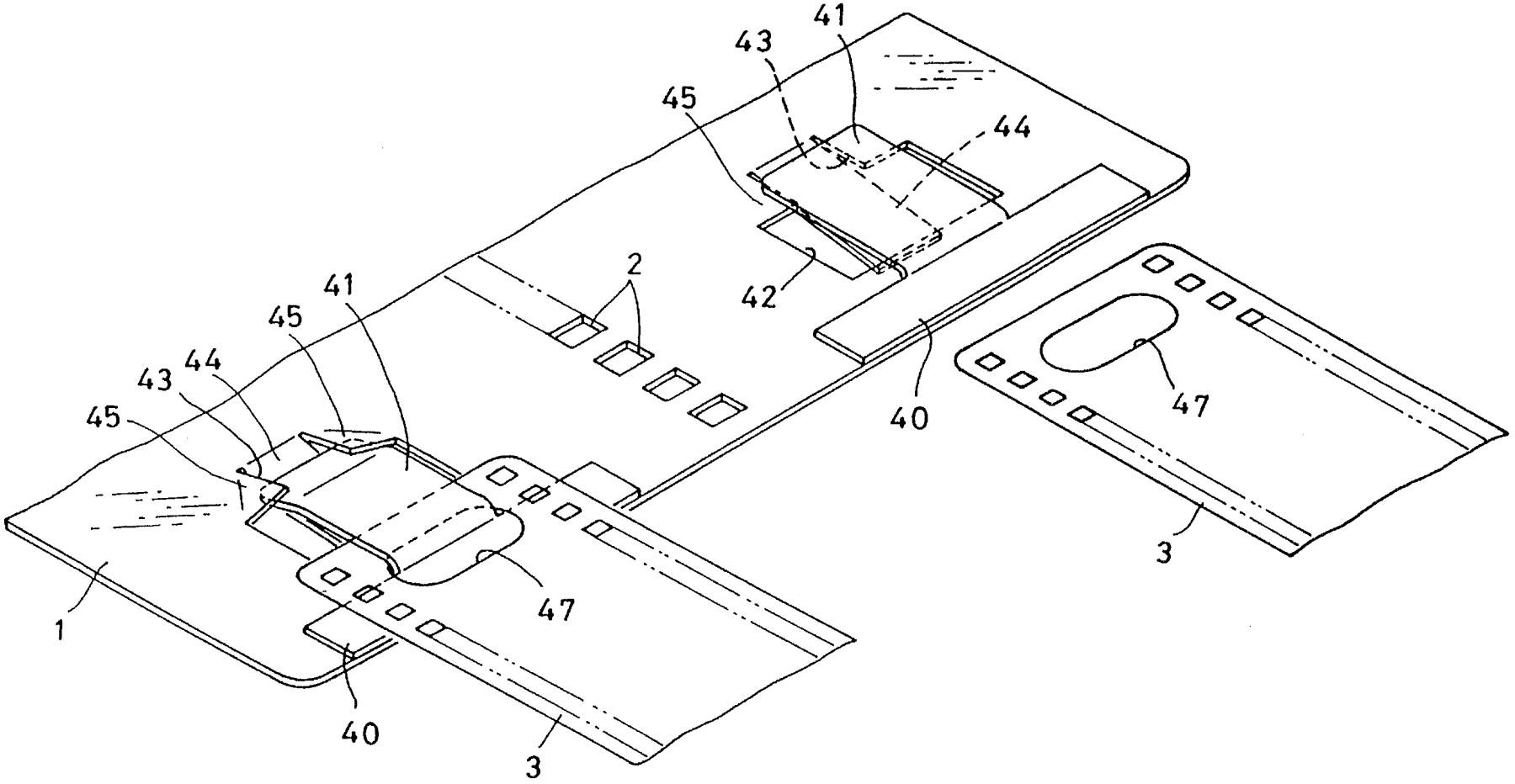
FIG. 7 is a perspective view of a fifth embodiment.

FIG. 7 shows the fifth embodiment of the film 3 coupling structure according to this invention. In this embodiment, sheet members 40 are fixed on the rear end of the top of the leader 1. Each sheet member 40 has an engaging tab 41 which extends from one side of the sheet member 40 in the feed direction of the leader 1.

The leader 1 is formed with windows 42 at positions opposite to the engaging tabs 41. A pair of cutouts 43 are formed along the front (with respect to the feed direction of the leader) of each window 42 so as to extend in the feed direction of the leader 1. Between both sides of each of the cutouts 43 is provided a protective tab 44, while on both sides of the cutouts 43 are defined a pair of tabs 45 which serve to prevent the film from disengaging from the leader 1.

In order to couple each film 3 to the leader 1, after engaging the engaging tab 41 in an inserting hole 47 of the film 3, the end of the engaging tab 41 is deformed to bring it into engagement with the underside of the tabs 45.

To detach the film 3, the engaging tab 41 is withdrawn from the tabs 45 and then disengaged from the engaging hole 47.

As shown in the fifth embodiment, the tabs 45 serve to prevent the engaging tab 41 from being deformed upward, so that the engaging tab 41 can be stably retained in the engaging hole 47. Thus, the films 3 will never separate from the leader 1 while being fed.

Figure 8:
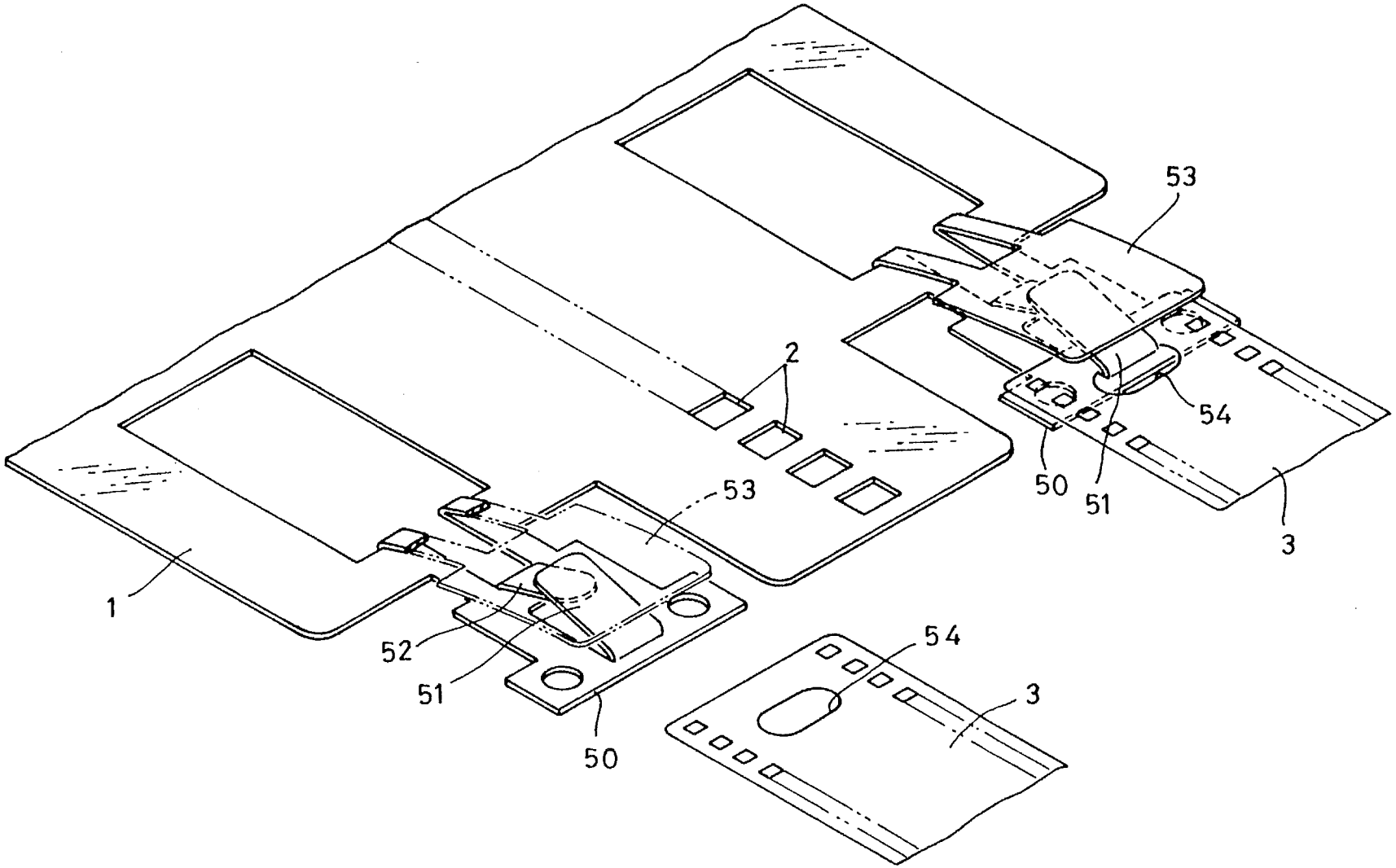
FIG. 8 is a perspective view of a sixth embodiment.
Figure 9:
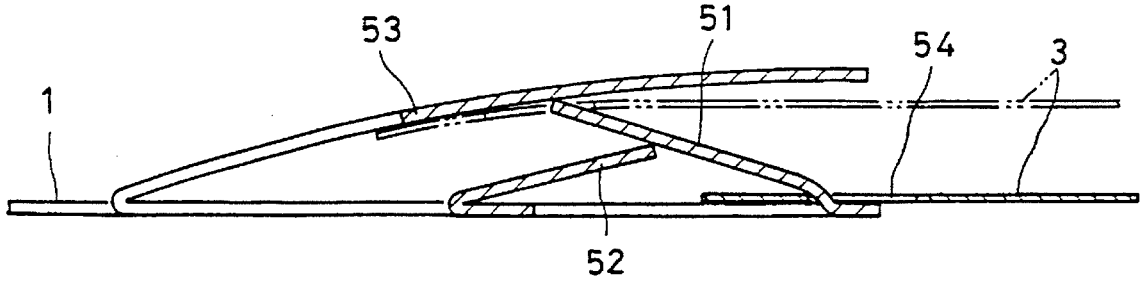
FIG. 9 is a sectional view of the same showing how the film is coupled.
Figure 10:
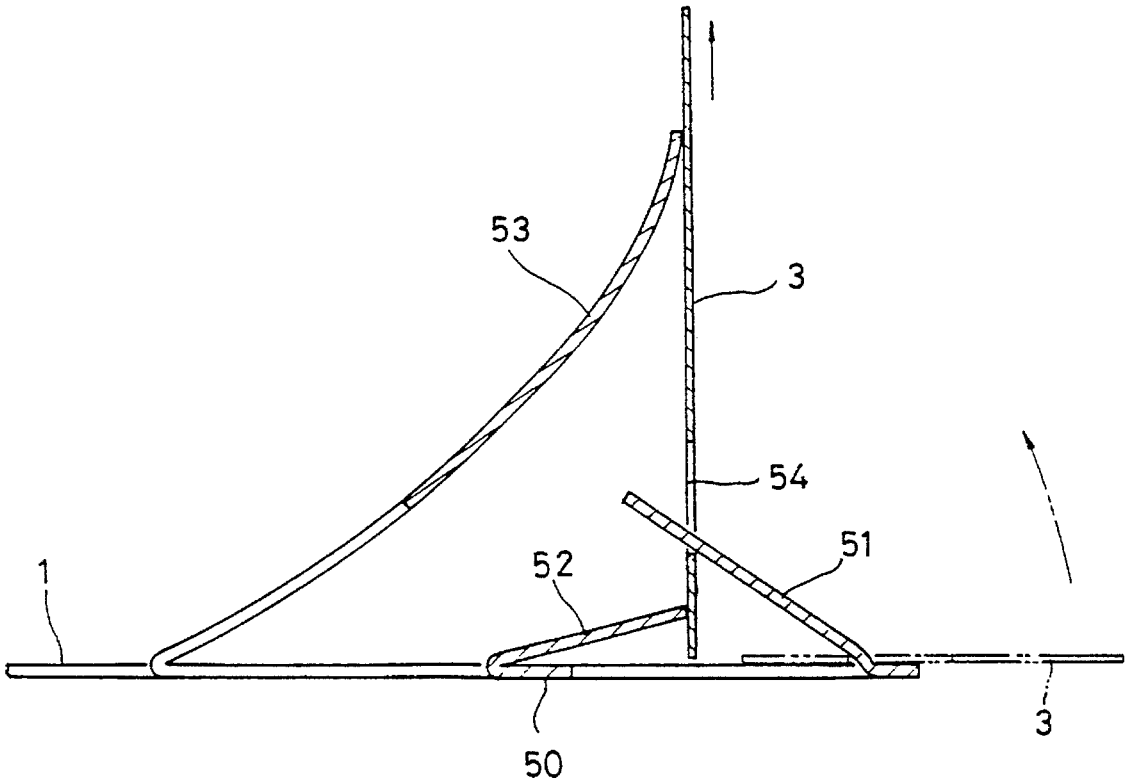
FIG. 10 is a sectional view of the same showing how the film is detached.
Figure 11:
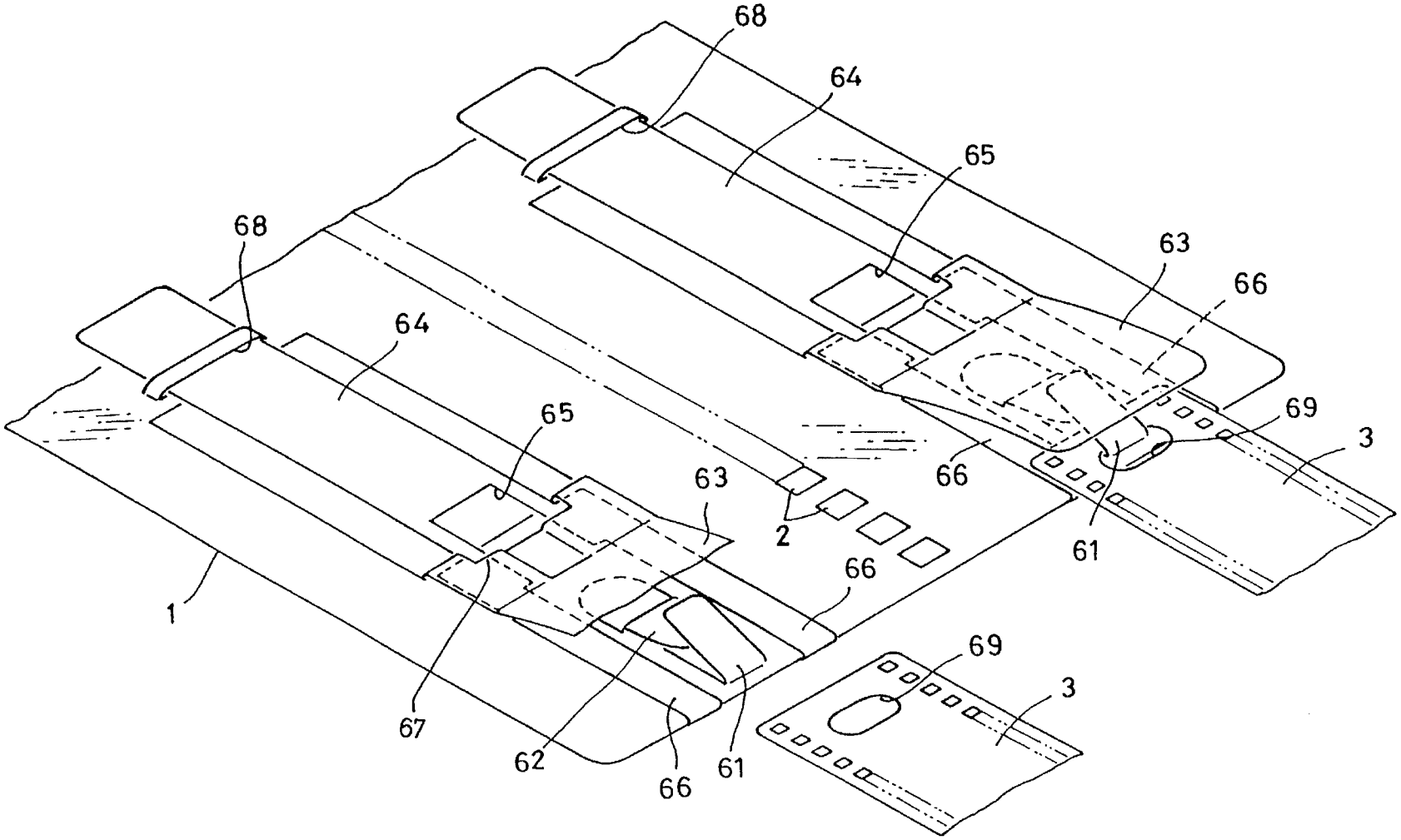
FIG. 11 is a perspective view of a seventh embodiment.

FIGS. 8–10 show the sixth embodiment of the film coupling structure according to this invention. In this embodiment, a pair of coupling pieces 50 are formed on both sides of the rear edge (with respect to the feed direction) of the leader 1. Each coupling piece 50 has an engaging tab 51 extending in the feed direction of the leader 1 and another tab 52 extending in the opposite direction and adapted to engage the engaging tab 51. The tab 52 has its free end resiliently in contact with the underside of the engaging tab 51.

The leader 1 is further provided with covering tabs 53 which extend rearward with respect to the feed direction of the leader 1 so as to cover the respective engaging tabs 51.

When coupling each film 3 to the leader 1, the end of the film 3 is pushed in along the inner surface of the covering tab 53. After the film 3 has been pushed in until a hole 54 formed therein pass over the free end of the engaging tab 51, the film 3 is pulled back to allow the engaging tab 51 to enter in the hole 54 as shown in FIG. 9.

In this coupled state, if the film 3 is pushed toward the leader 1, its end will abut the inner surface of the tab 52. Thus, the engaging tab 51 will never come out of the hole 54.

Each film 3 can be detached from the leader by placing its end on the film coupling piece 50 and pulling it up as shown in FIG. 10.

FIGS. 11–14 show the seventh embodiment. In this embodiment, the leader 1 has no film coupling pieces 50 of the sixth embodiment. Instead, it has engaging tabs 61 and tabs 62 adapted to engage the engaging tabs 61. They are formed by cutting the leader 1 and raising the portions between the cuts. The engaging tabs 61 are covered with covering tabs 63 whose front ends are secured to the leader 1.

Further, the leader 1 has control pieces in the form of plate strips 64 which are integrally connected to the rear edge of the leader 1 and folded back upon the leader 1. Each plate strip 64 has a window 65 to define narrow strip portions 66 on both sides thereof. It is slidably inserted in a hole 67 formed in a bent portion of each covering tab 63 and a guide portion 68 of the leader 1.

Figure 12:
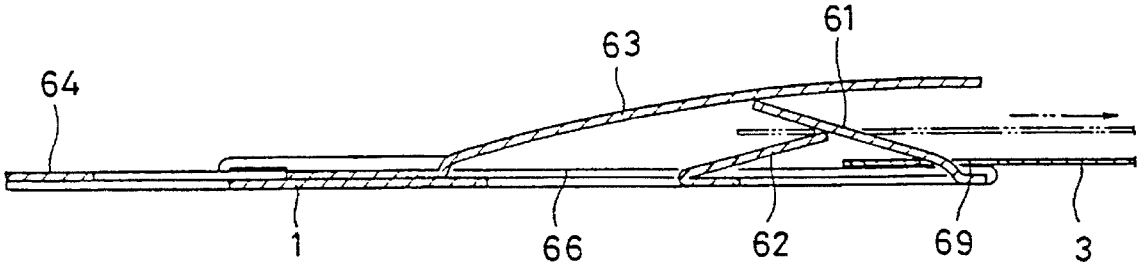
FIG. 12 is a sectional view of the same showing how the film is coupled.
Figure 13:
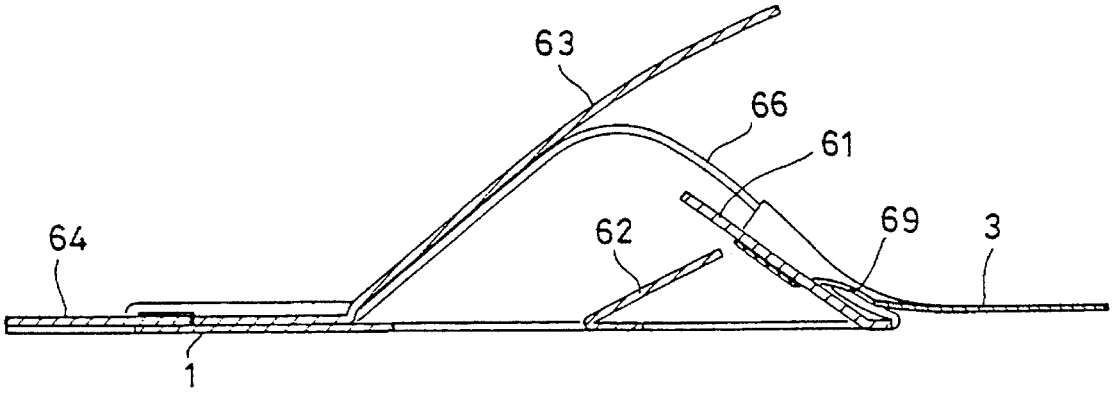
FIGS. 13 and 14 are sectional views of the same showing how the film is detached.

In this embodiment, as shown in FIG. 12, in the same manner as in the sixth embodiment, the end of the film 3 is pushed in along the inner surface of the covering tab 63 until a hole 69 at the end of the film passes over the end of the engaging tab 61 and then the film is pulled back.

Figure 14:
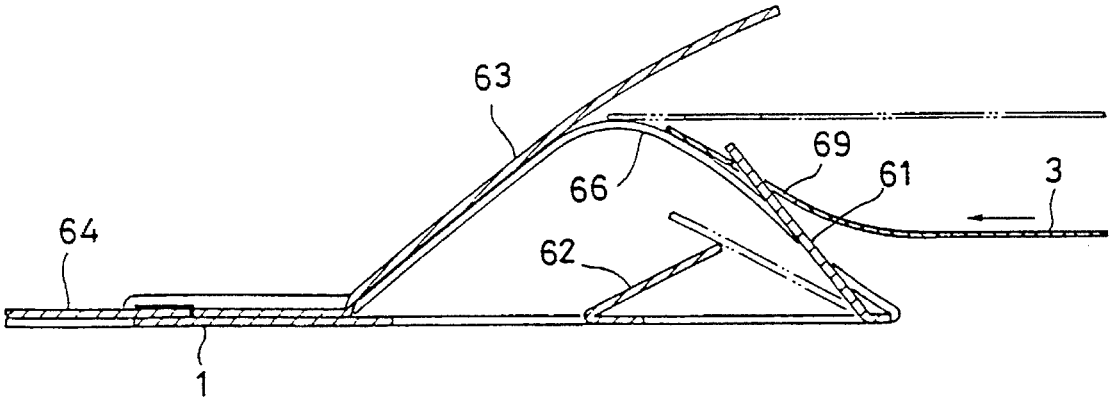

In order to detach each film 3 from the leader 1, the plate strip 64 is slid toward the film 3 to warp its narrow strip portions 66 upwards and thus to raise the engaging tab 61 (FIG. 3). The engaging tab 61 thus separates from the end of the tab 62. In this state, the film 3 is pushed toward the covering tab 63 to slide its end along the warped narrow strip portions 66. At this time, the engaging tab 61 is raised still further as shown in FIG. 14 and, when the film 3 is pushed in, the engaging tab 61 comes out of the hole 69. The film 3 is thus detached from the leader 1.

FIGS. 15–19 show the eighth embodiment in which the leader 1 has cuts 70 and two pairs of engaging tabs 71. Each film 3 is provided in the front end thereof with a pair of transversely disposed engaging holes 72.

Each cut 70 comprises a pair of center cuts 73 extending in the feed direction of the leader 1 and spaced apart from each other by a distance shorter than the width of the film 3, rear cuts 74 extending obliquely from the rear ends (with respect to the feed direction of the leader) of the center cuts 73, and front cuts 75 extending obliquely from the front ends of the center cuts 73.

The rear cuts 74 may be linear ones that extend perpendicular to the center cuts 73. However, in order that the end of the film 3 can be inserted easily, they should be preferably in the form of elongate holes extending obliquely outwards. The distance between the outer ends of the rear cuts 74 is slightly larger than the width of the film 3.

Figure 15:
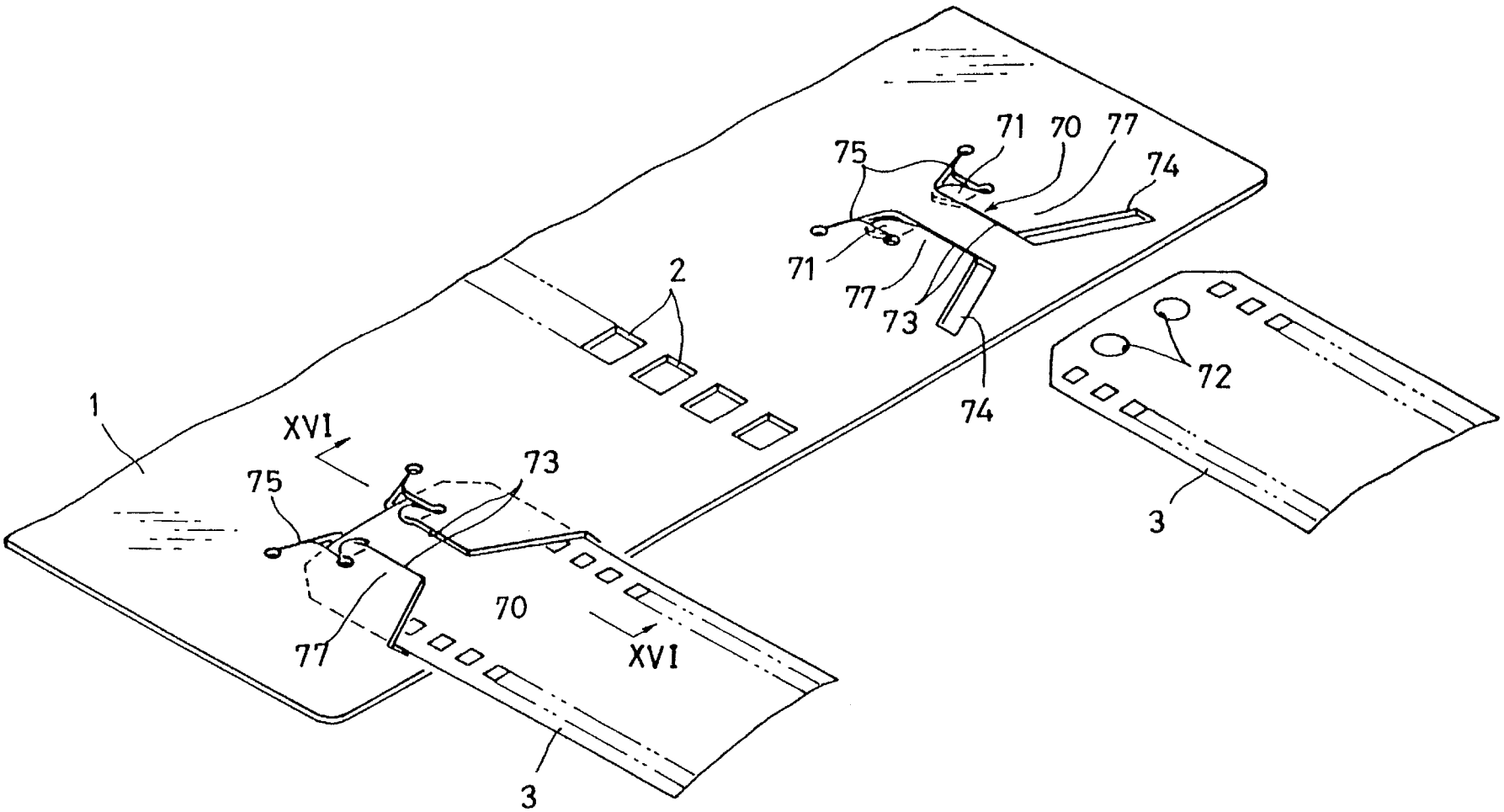
FIG. 15 is a perspective view of an eighth embodiment.
Figure 16:
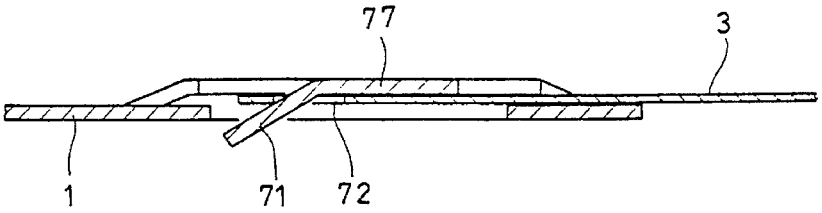
FIG. 16 is a sectional view taken along line XVI—XVI of FIG. 15.

The insertable length of the film 3 is restricted by the front cuts 75. Specifically, the distance between the outer ends of the front cuts 75 is smaller than the width of the film 3. The front cuts 75 may extend obliquely outwards as shown in FIG. 15 or may extend perpendicular to the center cuts 73.

The engaging tabs 71 are provided between the rear cuts 74 and the front cuts 75. They are bent toward the underside of the leader 1 and extend in the feed direction of the leader 1.

Figure 17:
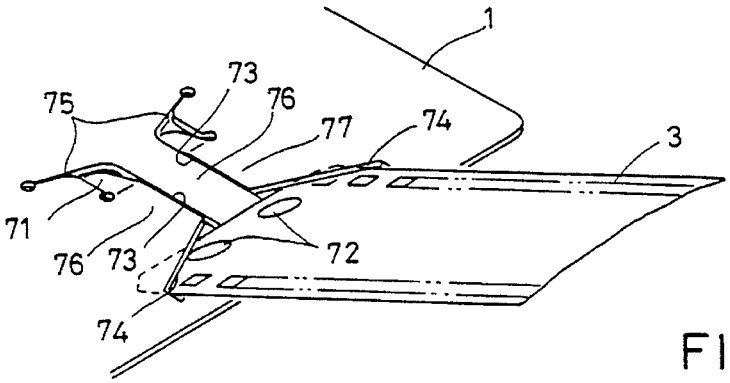
FIG. 17 is a perspective view of the same showing the film being coupled.

As shown in FIG. 17, when the end of the film 3 is inserted into the pair of rear cuts 74 and slid along the top surface of a lower guide 76 provided between the pair of center cuts 73, both sides of the film 3 slide along the bottom surfaces of film pressing tabs 77 formed outside of the center cuts 73. When the end of the film 3 passes under the engaging tabs 71, the engaging tabs 71 are deformed upwards.

Figure 18:
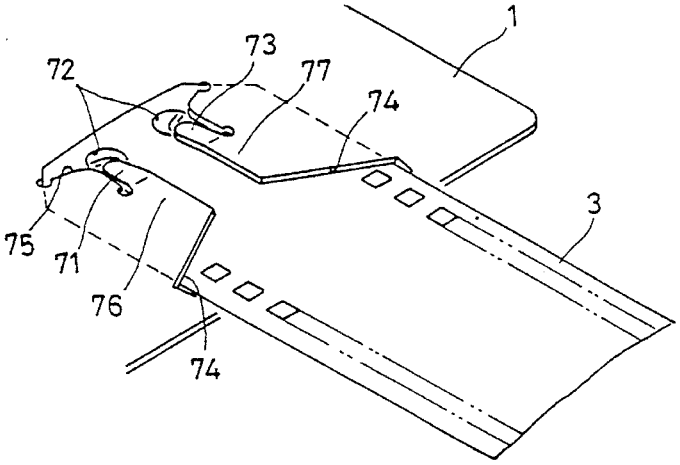
FIGS. 18 and 19 are sectional views of the same showing how the film is detached.

As shown in FIG. 18, the film 3 cannot be inserted any deeper when it abuts the leader 1 at the outer ends of the front cuts 75. By pulling back the film 3 in this state, the engaging tabs 71 are deformed downwards with the ends of the engaging tabs 71 located opposite to the engaging holes 72, so that the engaging tabs 71 enter in the engaging holes 72. The film 3 is thus coupled to the leader.

Figure 19:
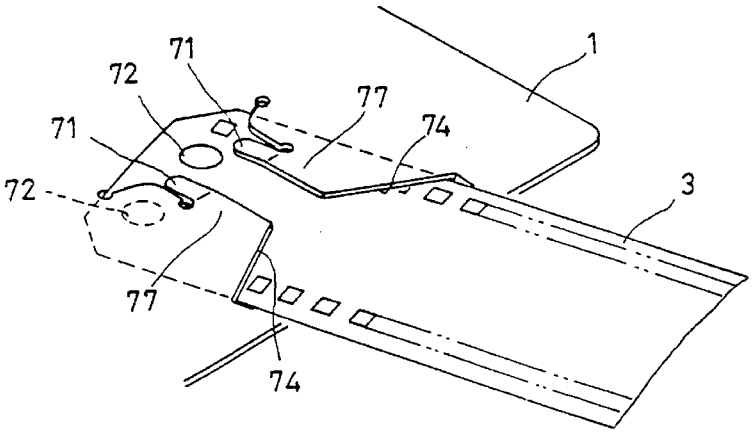

In order to detach the film 3, it is pushed in until it abuts the leader 1 at the outer ends of the front cuts 75 to move the engaging tabs 71 out of the engaging holes 72 as shown in FIG. 18. In this state, the film 3 is skewed relative to the leader 1 as shown in FIG. 19, and the film 3 is pulled out with the engaging tabs 71 and the engaging holes 72 displaced from each other.

Figure 20:
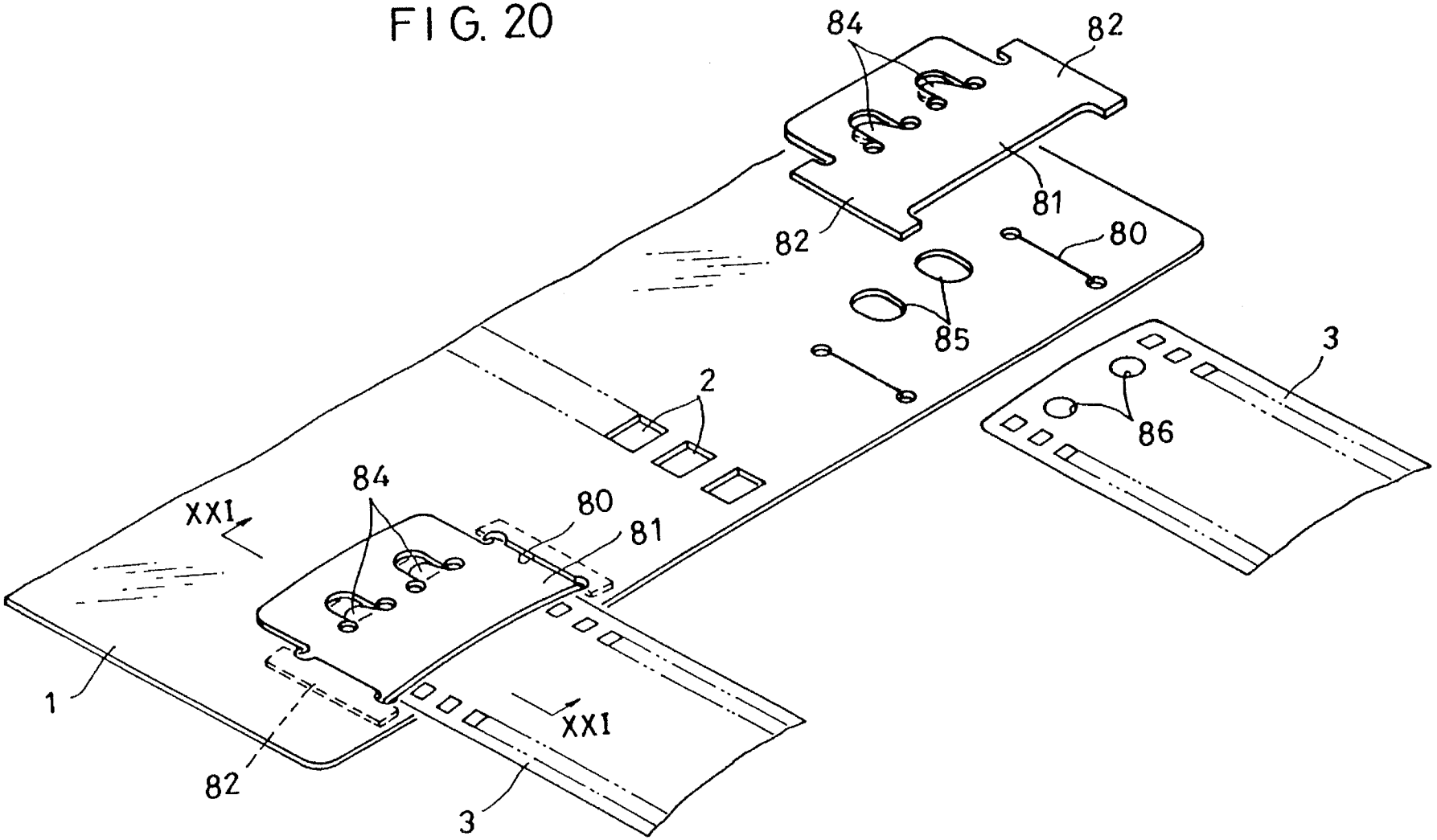
FIG. 20 is a perspective view of a ninth embodiment.
Figure 21:
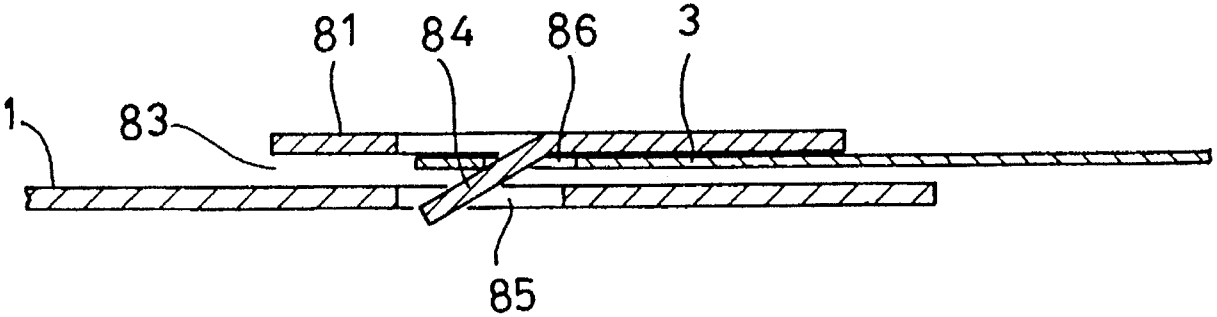
FIG. 21 is a sectional view taken along line XXI—XXI of FIG. 20.
Figure 22:
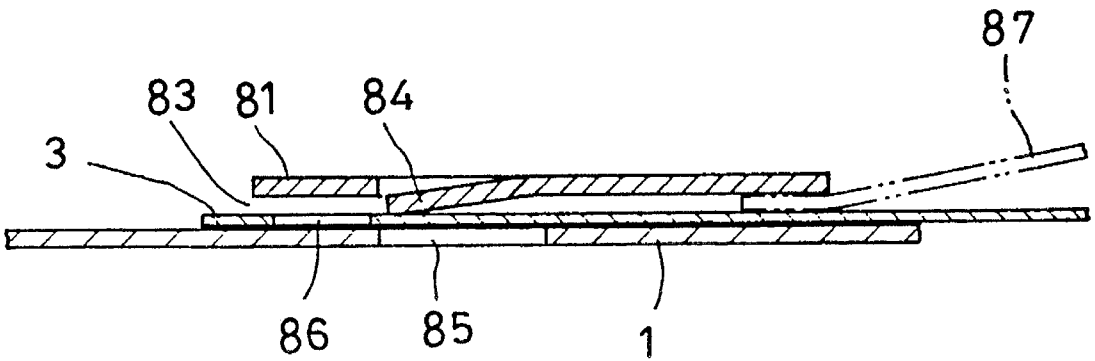
FIG. 22 is a sectional view of the same showing the film being detached.
Figure 23:
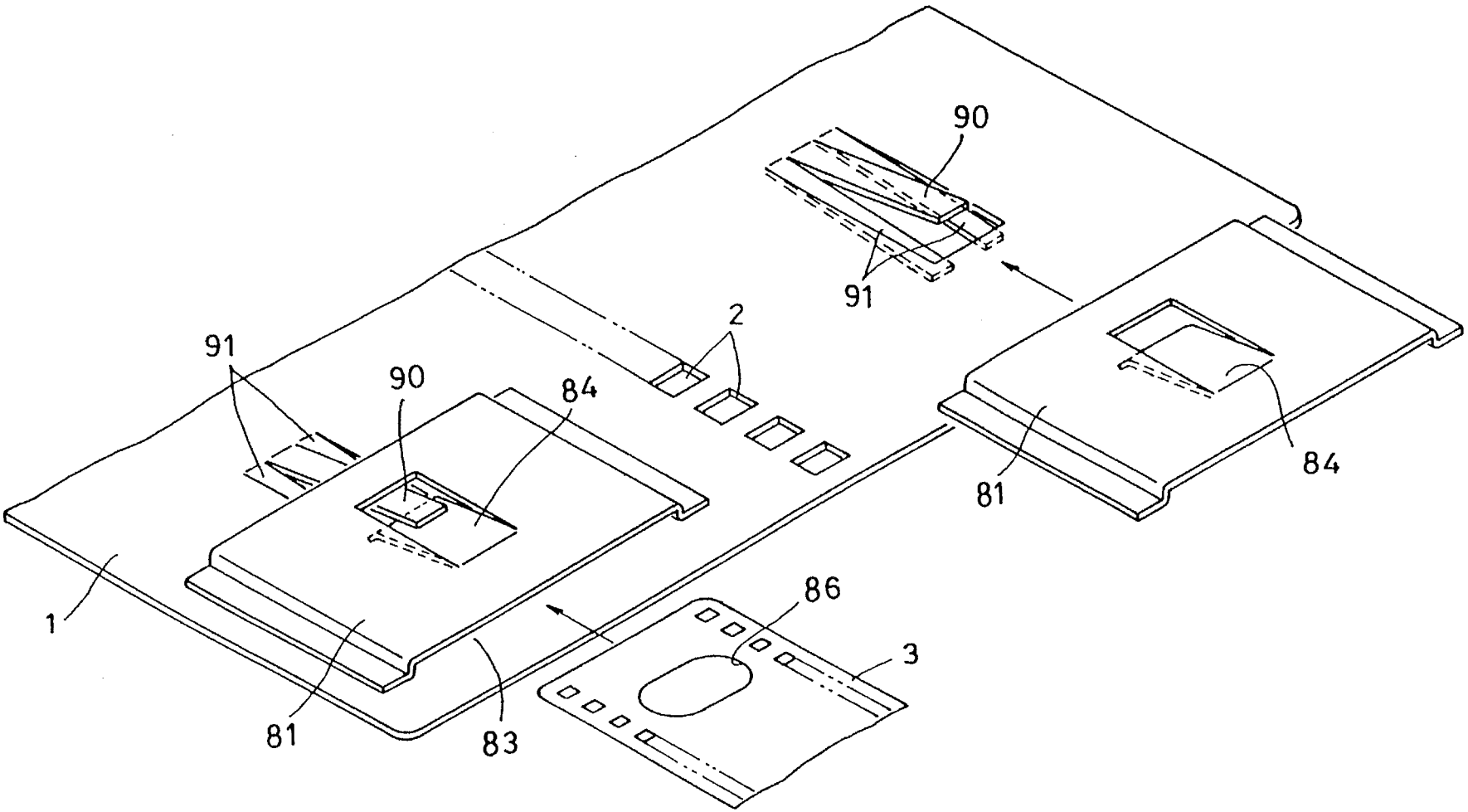
FIG. 23 is a perspective view of a tenth embodiment.
Figure 24:
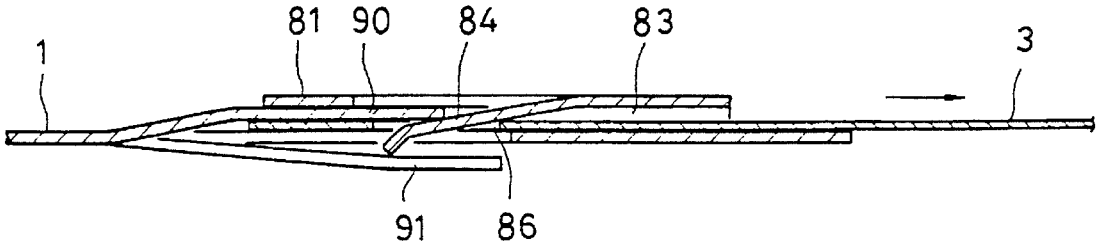
FIG. 24 is a sectional view of the same showing how the film is coupled.
Figure 25:
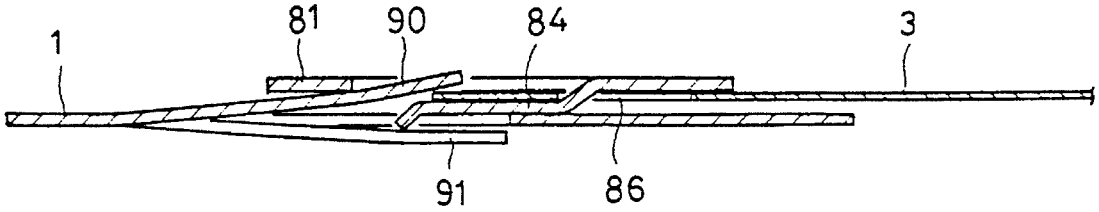
FIG. 25 is a sectional of the same showing the coupled film.
Figure 26:
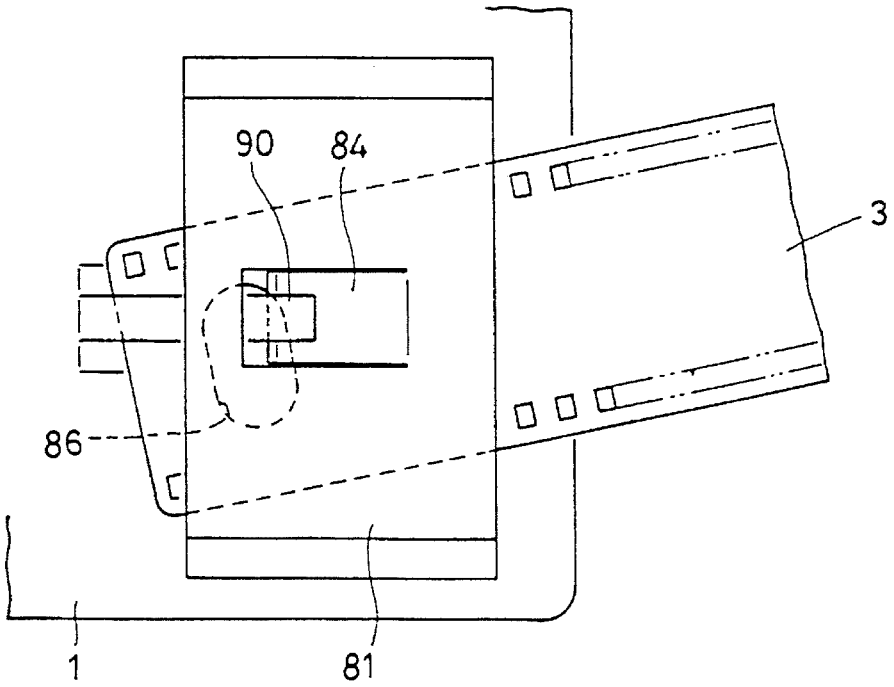
FIG. 26 is a perspective view of the same showing how the film is detached.
Figure 27:
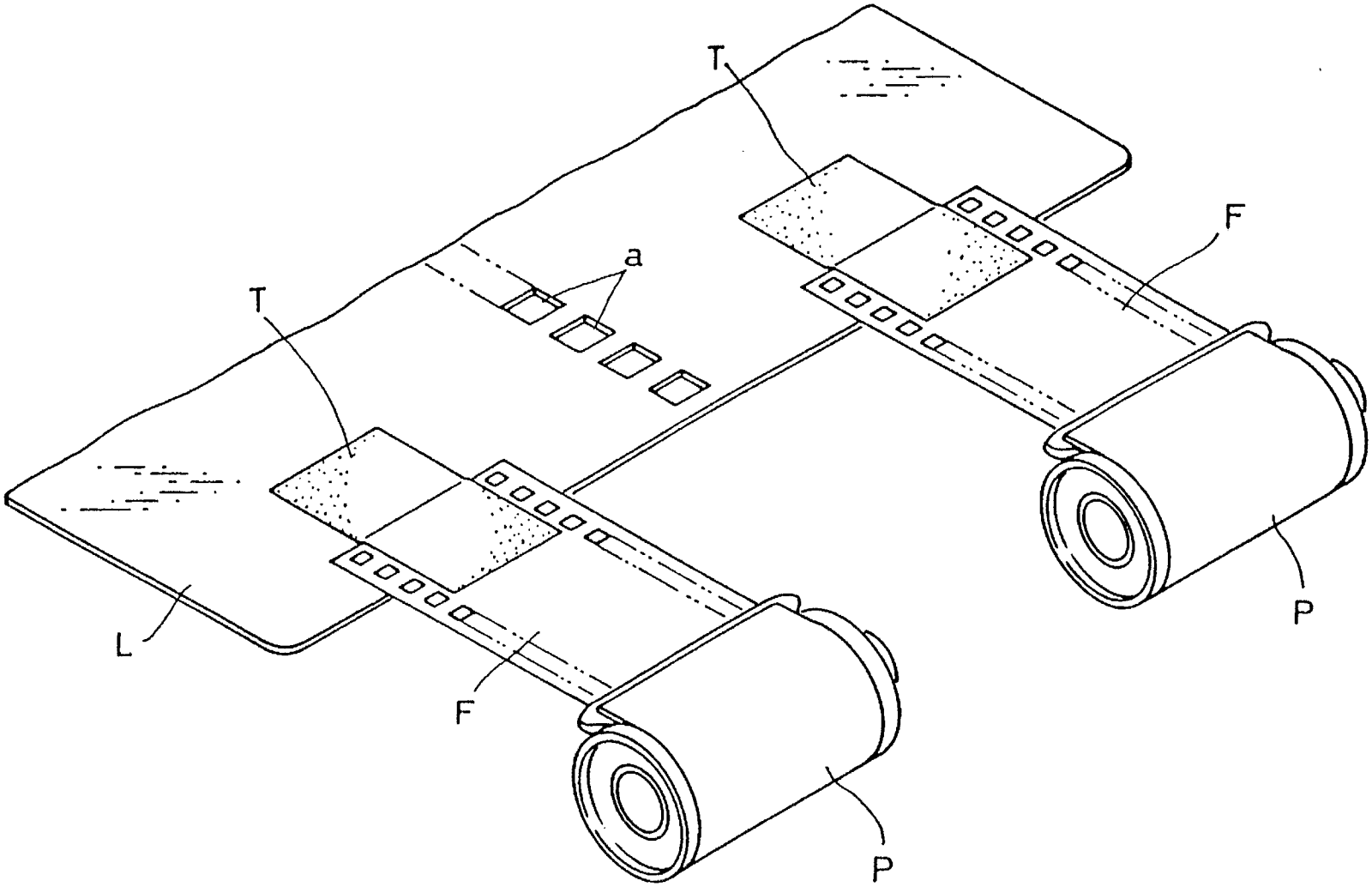
FIG. 27 PRIOR ART
FIG. 27 is a perspective view showing a conventional film coupling structure.

FIGS. 20–22 show the ninth embodiment in which the leader 1 is provided in the rear end thereof with two pairs of cuts 80. In each pair of cuts 80 are inserted engaging tabs 82 provided on both sides of a sheet member 81 so as not to come out of cuts 80. Between each sheet member 81 and the leader 1 is defined a film inserting space 83 into which the end of the film 3 is to be inserted.

Each sheet member 81 has a pair of right and left engaging tabs 84 formed by cutting the sheet member 81. They are bent downwardly. They are also inclined in the direction in which the film 3 is inserted in the film inserting space 83, and have their ends inserted in holes 85 formed in the leader 1.

On the other hand, the film 3 has in its front end a pair of engaging holes 86 sized to receive the engaging tabs 84.

In order to couple each film 3 to the leader 1, the end of the film 3 is inserted into the film inserting space 83. When the end of the film 3 passes under the engaging tabs 84, the tabs 84 are deformed upwardly. When the film end is inserted until the engaging holes 86 pass the front ends of the engaging tabs 84, the film 3 is pulled back (FIG. 22). The engaging tabs 84 will be deformed downwards when the engaging holes 86 are located opposite to the engaging tabs 84 so that the tabs 84 enter in the engaging holes 86. The film 3 is thus coupled to the leader 1.

In order to detach each film 3 from the leader 1, the film 3 is pushed to disengage the engaging tabs 84 from the engaging holes 86. Then, an inserting piece 87 shown by chain lines in FIG. 22 is inserted between the film 3 and the sheet member 81. In this state, the film 3 is pulled out together with the inserting piece 87 with the engaging holes 86 closed by the inserting piece 87.

Alternatively, the film 3 may be pulled out after skewing the leader 1 and the film 3 relative to each other to displace the engaging holes 86 and the engaging tabs 84 relative to each other in the same manner as shown in FIG. 19.

As shown in FIG. 20, the sheet member 81 is attached to the leader 1 by inserting the engaging tabs 82 on both sides of the sheet member 81 into the cuts 80 formed in the leader. However, both ends of the sheet member 81 may be instead secured to the leader 1 by adhesive or ultrasonic welding.

FIGS. 23–26 show the tenth embodiment. In this embodiment, in place of the holes 85 of the ninth embodiment, the leader 1 is provided with tabs 90 for preventing films from coming out of the leader 1 and two pairs of protective tabs 91 provided on both sides of the tabs 90. Each tab 90 has its free end resiliently in contact with the top surface of the engaging tab 84 at its free end. The protective tabs 91 are also resiliently kept in contact with the free end of the engaging tab 84.

Otherwise, this embodiment is of the same structure as the ninth embodiment. Thus, like parts are denoted by like numerals and their description is omitted. The film 3 is coupled to and detached from the leader in the same manner as in the ninth embodiment.

By providing the leader 1 with the tabs 90 in the tenth embodiment, the tabs 90 serve to prevent upward deformation of the engaging tabs 84. Thus, while the films 3 are coupled to the leader, the engaging tabs 84 are kept in the engaging holes 86 in the film, so that the films 3 will never come off the leader 1 and can be fed reliably together with the leader 1.

The protective tabs 91 are inclined rearwardly to cover the free end of each engaging tab 84. Thus, while feeding the leader 1 and the films 3, the engaging tabs 84 will never get caught by any obstacles in the feed path, so that the leader 1 and the films 3 can be fed smoothly.

What is claimed is:

1. An arrangement for coupling a film to a leader, said arrangement comprising: a leader having an insertion hole, an engaging tab projecting from an edge of the leader defining a rear end of said insertion hole with respect to a feed direction in which the leader is to be fed, and a cutout spaced rearwardly of said insertion hole with respect to said feed direction; and a film having a front end narrower than a portion of the film to which the front end is contiguous and insertable into the insertion hole of said leader so as to serve as a coupling portion, an engaging hole sized to receive said engaging tab of the leader, and shoulders at sides of said portion of the film, respectively, said cutout having a width substantially equal to the width of said coupling portion, and said shoulders being engageable with the back of the leader on both sides of said cutout with said engaging tab received in said engaging hole to thereby couple the film to the leader.

2. An arrangement for coupling a film to a leader, said arrangement comprising: a leader having an engaging hole in a rear end thereof with respect to a feed direction in which the leader is to be fed, and a pair of cutouts spaced rearwardly of said engaging hole with respect to said feed direction; and a film having a front end including a neck narrower than a portion of the film to which the front end is contiguous, an engaging tab connected by said neck to said portion of the film, and shoulders located behind said neck at sides of said portion of the film, respectively, said engaging hole being sized to receive said engaging tab of the film, said pair of cutouts being spaced apart from each other by a distance substantially equal to the width of said neck, and said sides of the film being insertable through said cutouts such that said shoulders are engageable with the back of the leader on outer sides of said cutouts, respectively, with said engaging tab received in said engaging hole to thereby couple the film to said leader.

3. An arrangement for coupling a developable film to a leader, said arrangement comprising: a developable film having a respective series of perforations in each of opposite sides thereof; and a leader having a cutout in a rear end thereof with respect to a feed direction in which the leader is to be fed, said cutout having a width substantially equal to the distance between said series of perforations in the opposite sides of the film, and a plurality of engaging tabs extending into said cutout from each of opposite sides of said cutout, said engaging tabs being inserted into said perforations to thereby couple the film to the leader.

4. An arrangement for coupling a film to a leader as claimed in claim 3, wherein said cutout extends to the rear edge of said leader with respect to the feed direction.

5. An arrangement for coupling a film to a leader, said arrangement comprising: a film having an engaging hole in a front end thereof; and a leader having an engaging tab at a rear end thereof with respect to a feed direction in which the leader is to be fed, said tab extending in said feed direction, a window at a position opposite to said engaging tab, a pair of cuts extending in the feed direction from an edge of the leader defining the front of said window with respect to said feed direction, and a pair of tab tabs formed on outer sides of said cuts and spaced from one another so as to receive both sides of the front end of said engaging tab, respectively, while said engaging tab extends through said engaging hole to thereby couple the film to said leader.

6. An arrangement for coupling a film to a leader, said arrangement comprising: a film having an engaging hole in a front end thereof; and a leader having an engaging tab at a rear end thereof with respect to a feed direction in which the leader is to be fed, said tab extending in said feed direction, and a cover member which extends rearwards with respect to the feed direction and covers said engaging tab while said engaging tab extends through said engaging hole to thereby couple the film to said leader.

7. An arrangement for coupling a film to a leader as claimed in claim 6, wherein the leader has a control piece in the form of a strip integral with the rear end of the leader, said control piece being folded back so as to overlie the top surface of the leader and so as to be slidable therealong, said control piece having a window through which said engaging tab extends, and said control piece having a pair of plate strips defined at both sides of said window, said plate strips being arcuately deformable in such a way as to push up said cover member when said control piece is slid in a direction opposite to the feed direction.

8. An arrangement for coupling a film to a leader said arrangement comprising: a film having a pair of engaging holes in a front end thereof; and a leader having a series of cuts in a rear end thereof, with respect to a direction in which the leader is to be fed, for accepting the front end of the film, said series of cuts including a pair of substantially straight center cuts extending in the feed direction and spaced apart from each other by a distance less than the width of the film, and front and rear cuts extending obliquely from front ends and rear ends of said center cuts, respectively, and said leader also having a pair of engaging tabs formed between said front and said rear cuts, said engaging tabs being insertable into said engaging holes of the film to thereby couple the film to said leader.

9. An arrangement for coupling a film to a leader, said arrangement comprising: a film having an engaging hole in a front end thereof; a leader; and a sheet member attached to the top surface of the leader at a rear end thereof with respect to a feed direction in which the leader is to be fed, said sheet member having both sides thereof coupled to the leader to define a film inserting space between said sheet member and the leader, said sheet member also having an engaging tab extending into said film inserting space, said engaging tab being insertable into said engaging hole in the film while the front end of the film is in said film inserting space to thereby couple the film to said leader.

10. An arrangement for coupling a film to a leader as claimed in claim 9, wherein said leader also has a retaining piece adapted to engage the top surface of said engaging tab at a front end thereof, and a protective piece adapted to engage the bottom surface of said engaging tab.

* * * * *